US007871154B2

(12) United States Patent
Loyer

(10) Patent No.: US 7,871,154 B2
(45) Date of Patent: Jan. 18, 2011

(54) PIEZOELECTRIC PRINTHEAD

(75) Inventor: Daniel W. Loyer, San Clemente, CA (US)

(73) Assignee: MVM Technologies, Inc, San Clemente, CA (US)

( * ) Notice: Subject to any disclaimer, the term of this patent is extended or adjusted under 35 U.S.C. 154(b) by 295 days.

(21) Appl. No.: 11/996,805

(22) PCT Filed: Jul. 26, 2006

(86) PCT No.: PCT/US2006/029182

§ 371 (c)(1),
(2), (4) Date: Jun. 20, 2008

(87) PCT Pub. No.: WO2007/016237

PCT Pub. Date: Feb. 8, 2007

(65) Prior Publication Data

US 2008/0316281 A1 Dec. 25, 2008

Related U.S. Application Data

(60) Provisional application No. 60/703,796, filed on Jul. 29, 2005.

(51) Int. Cl.
*B41J 2/045* (2006.01)

(52) U.S. Cl. ..... 347/71

(58) Field of Classification Search ..... 347/71, 347/68–70, 72, 40–43, 44, 47, 63, 20; 310/311, 310/324; 400/124.14, 124.16; 29/25.35, 29/890.1

See application file for complete search history.

(56) References Cited

U.S. PATENT DOCUMENTS

| | | | |
|---|---|---|---|
| 4,395,719 | A | 7/1983 | Majewski et al. |
| 6,428,140 | B1 | 8/2002 | Cruz-Uribe |
| 2004/0140732 | A1 | 7/2004 | Truninger et al. |

*Primary Examiner*—K. Feggins
(74) *Attorney, Agent, or Firm*—Fish & Associates, PC

(57) ABSTRACT

Contemplated printheads include a piezoelectric material in which a channel is formed across the piezoelectric material to thereby create at least part of the nozzle through which ink is expelled from the inside of the printhead to the outside. Contemplated nozzles may be configured as cylindrical elements or ring-shape elements. Consequently, application of a voltage across the piezoelectric channel may result in constriction of the cylindrical element or convex/concave deformation of the ring-shape element. Most preferably, the piezoelectric material, conductive traces, and supporting structures are applied from a liquid phase to a carrier, and shaped using photolithographic methods.

24 Claims, 3 Drawing Sheets

PIEZOELECTRIC PRINTHEAD

This application claims the benefit of our U.S. provisional patent application with the Ser. No. 60/703,796, which was filed Jul. 29, 2005, and which is incorporated by reference herein.

FIELD OF THE INVENTION

The field of the invention is inkjet printheads.

BACKGROUND OF THE INVENTION

There are numerous inkjet printhead configurations known in the art, and many of such printheads employ piezoelectric actuators in the ink reservoir or ink channel to pump the ink to the nozzle from which it is then ejected as ink droplets. Depending on the configuration of the printhead, various difficulties remain. For example, where the actuators form a wall or a wall element of a reservoir that is located close to the nozzle, cross talk between the compartments is often encountered. On the other hand, and especially where the actuator is located in a position relatively remote from the nozzle, pressure loss/dissipation may present a problem. Moreover, as most of the piezoelectric materials in the known printheads are inorganic compositions, and due to the complex arrangement of the component parts, the size of currently known printheads is typically limited to relatively small dimensions.

Therefore, while there are numerous inkjet printheads with piezoelectric actuators known in the art, all or almost all of the suffer from one or more disadvantages. Thus, there is still a need to provide improved compositions and methods for inkjet printers with piezoelectric actuators.

SUMMARY OF THE INVENTION

The present invention is directed to printheads with a piezoelectric actuator, wherein at least part of the nozzle of the printhead is formed from a piezoelectric material. Most preferably, the piezoelectric material will include a pore that extends through the thickness of a layer of the piezoelectric material such that a channel is formed through which the ink is ejected from the inside of the printhead to a surface outside of the printhead. In still further particularly preferred aspects, the piezoelectric layer, the electric connectors, and other components of the printhead are formed from flowable (typically liquid) materials that are deposited to form corresponding layers, which are then shaped into the desired configuration using photolithographic methods well known in the art.

Therefore, in one aspect of the inventive subject matter, a printhead will include a piezoelectric layer that is electrically coupled to a first and a second conductive layer such that the piezoelectric layer deforms in response to a voltage applied to the first and second conductive layers. Most preferably, the piezoelectric layer in such printheads has a pore extending across the layer that forms a nozzle through which ink is expelled from a volume inside the printhead onto a surface outside of the printhead in response to the applied voltage.

Particularly preferred printheads include a piezoelectric layer formed from a piezoelectric polymer, which is typically a composite of an organic polymer and an inorganic piezoelectric material (e.g., polyvinylidenedifluoride and lead zirconium titanate). Contemplated piezoelectric layers may be configured as a monomorph piezoelectric structure (e.g., tubular shape), or as a bimorph piezoelectric structure (e.g., ring shape). Depending on the shape, the nozzle may thus constrict, or deflect to provide actuation of the ink. Where desirable, first and second conductive layers are formed as metallized polymers, and one or more (optionally porous) polymeric and/or inorganic layers may be coupled to the piezoelectric layer, the first, and/or the second conductive layers and be configured as an ink channel, an ink filter, an ink reservoir, a fluidic resistor, and/or an electrical connector to a control circuit. It is still further preferred that the piezoelectric layer, the first and/or second conductive layers, and other components have a composition that allows deposition of the layers from a liquid phase (e.g., via spin coating, screen printing, blade-assisted deposition, etc.).

In another aspect of the inventive subject matter, a method of forming a printhead nozzle will include a step of forming on a substrate a piezoelectric layer from a liquid composite material, and another step of forming a first conductive layer on the piezoelectric layer to thereby electrically connect the piezoelectric layer with the first conductive layer. In yet another step, a pore is formed through the piezoelectric layer, wherein the pore has a size sufficient to allow the pore to deform in an amount effective to expel ink from one side of the piezoelectric layer to the other when a voltage is applied to the first conductive layer.

Most preferably, the piezoelectric layer comprises a piezoelectric polymer (e.g., PVDF-lead zirconium titanate composite) and is deposited from a liquid phase. Similarly, it is generally preferred that the first and/or second conductive layers comprise a metallized polymer. As in devices discussed above, the piezoelectric layer may have monomorph or bimorph piezoelectric structure, and the pore may therefore have tube- or ring shape. In still further preferred aspects, a photoresist layer is deposited and patterned prior to the step of forming the piezoelectric layer and/or forming the conductive layer. Where desirable, an optionally porous polymeric or inorganic layer may be formed and coupled to at least one of the piezoelectric layer, the first and/or second conductive layers and be configured to provide at least one of ink channel, an ink filter, an ink reservoir, a fluidic resistor, and an electrical connector to a control circuit.

Various objects, features, aspects and advantages of the present invention will become more apparent from the following detailed description of preferred embodiments of the invention.

DETAILED DESCRIPTION

The inventors have discovered that a printhead can be manufactured by depositing layers of functional materials using photolithographic processes well known in the art to arrive at a layered structure that includes electric connectivity and a nozzle that is at least in part formed by piezoelectric material. Additional layers may be formed and coupled to the piezoelectric material and/or electric connectors to provide an ink reservoir, ink channel, and/or ink filter. Most preferably, the so constructed printhead is then laminated or otherwise coupled onto a polyamide or other carrier that includes the necessary circuit paths. Contemplated carriers may also include a conversion chip that converts thermal printhead signals into those that can be used by a piezoelectric element.

Figure 1A:
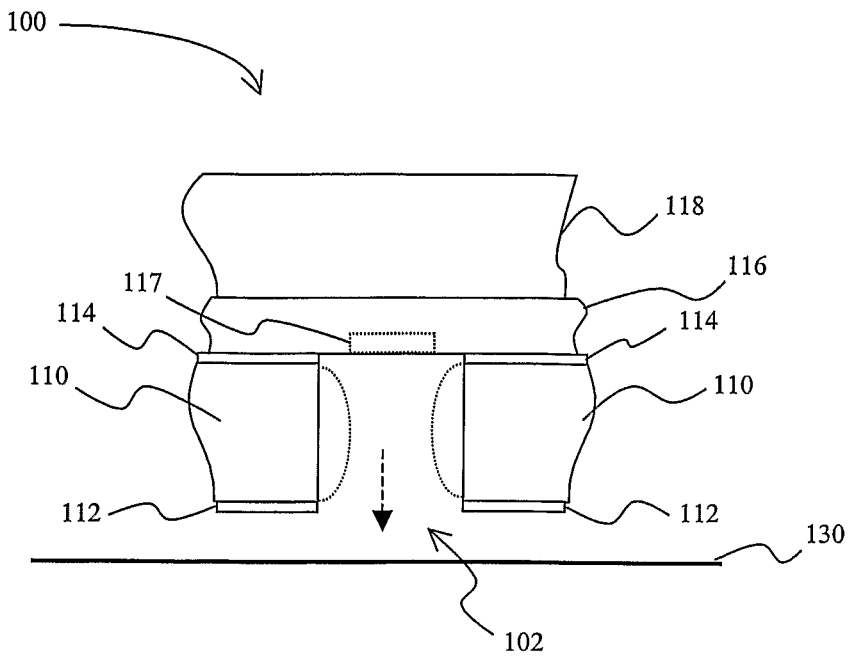
FIG. 1A is a schematic representation of one exemplary printhead according to the inventive subject matter.

In one exemplary aspect of the inventive subject matter as depicted in FIG. 1A, a printhead 100 includes a monomorph piezoelectric layer 110 that has a pore extending across the layer 110 to thereby form nozzle 102 having a tubular shape (only portion of the wall thickness is shown in this vertical cross section). Layer 110 is in electric contact with conductive layers 112 and 114, which provide the voltage required to excite the piezoelectric layer 110. Depending on the polarity of the electric field applied to the conductive layers 112 and 114, the piezoelectric layer 110 will either contract or expand, which in turn creates a bulge (dotted line) or a concave shape (not shown) at the nozzle wall, which in turn creates a pressure that ejects an ink drop (arrow) or a suction that refills at least part of the tubular space formed by the piezoelectric layer. Ink is preferably provided via a porous polymer or silicate layer 116. In such configurations, the porosity may be selected such that the layer 116 also acts as a ink filter and/or a barrier that prevents movement from the nozzle 102 back into the printhead 100. Alternatively, ink may also be provided from a reservoir (not shown) via a channel 117 in polymer layer 116. The channel may then be coupled to the reservoir via a fluidic resistor (e.g., porous material or other implement that prevents the ink from being moved back into the print head). Thus, application of a potential to the piezoelectric layer will excite the layer to form a constriction of at least part of the lunien that causes the ink to be ejected from the nozzle onto a surface 130. A support layer 118 may act as a physical support as well as a base providing driving circuitry, ink, and electrical connectivity to the printer.

In further alternative aspects (not shown), the piezoelectric layer may also be actuated by a first conductive layer that is coupled around the outer circumference of the tube-shaped pore. Such conductive outer band may cooperate with conductive ink on the inside of the pore to effect a localized constriction of the pore to thereby propel the ink out of the pore.

Figure 1B:
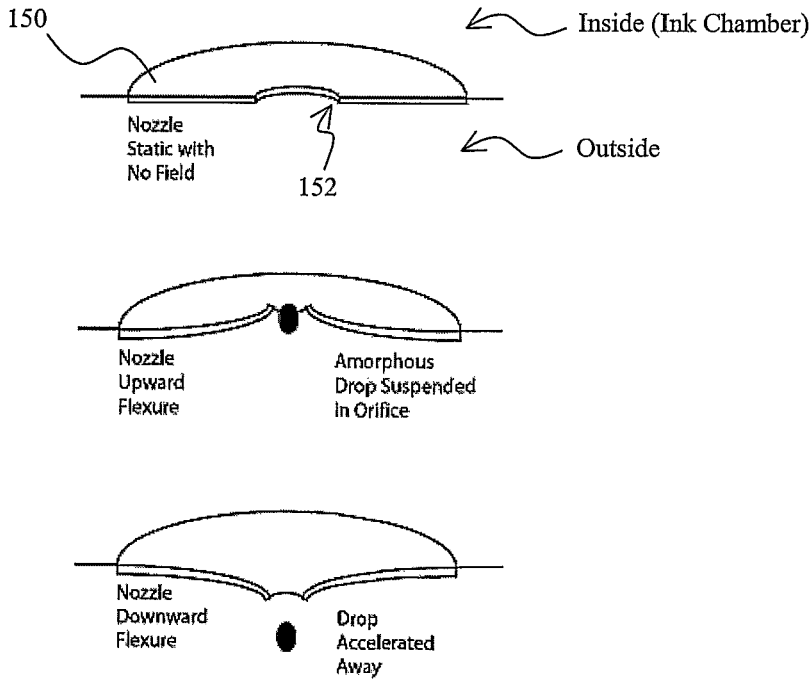
FIG. 1B is a schematic representation of another exemplary printhead according to the inventive subject matter.

In another exemplary aspect of the inventive subject matter, as depicted in FIG. 1B (only piezoelectric layers are shown, remaining structures correspond to like structures in FIG. 1A), the printhead includes a bimorph piezoelectric layer 150 that has ring-shaped configuration with a pore extending across the layer 150 to thereby form nozzle 152. Layer 150 is in electric contact with conductive layers (not shown), which provide the voltage required to excite the piezoelectric layer 150. Depending on the polarity of the electric field applied to the conductive layers 112 and 114, the piezoelectric layer 150 will either flex upwards or downwards, which in turn creates a concave or convex shape (as shown in the bottom schematics in FIG. 1B) of the layer with the nozzle. As a result, an amorphous volume of an ink drop will be suspended (in part by capillary force) in the nozzle, which is then ejected from the nozzle upon switching of the polarity. As in the example above, ink is preferably provided via a porous polymer or silicate layer that confines a space above the piezoelectric layer. In such configurations, the porosity may be selected such that the porous layer also acts as a ink filter and/or a barrier that prevents movement of the ink from the nozzle back into the printhead. Alternatively, ink may also be provided from a reservoir (not shown) via a channel in a polymer layer proximal to the piezoelectric layer. The channel may then be coupled to the reservoir via a fluidic resistor (e.g., porous material or other implement that prevents the ink from being moved back into the print head). A support layer (not shown) may act as a physical support as well as a base providing driving circuitry, ink, and electrical connectivity to the printer.

Figure 2A:
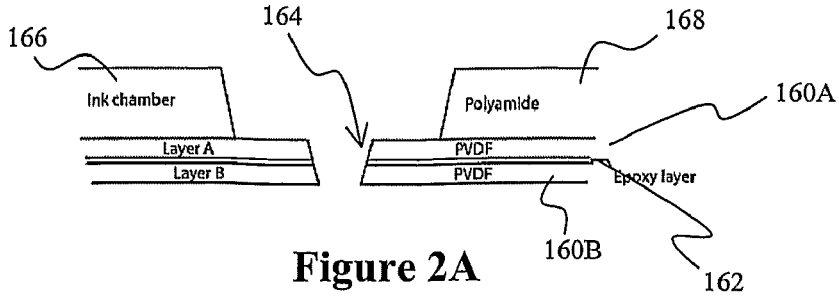
FIG. 2A-2C are more detailed schematic representations of some exemplary printhead configurations according to FIG. 1B.
Figure 2B:
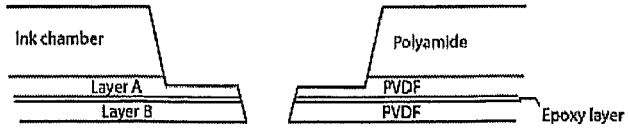
Figure 2C:
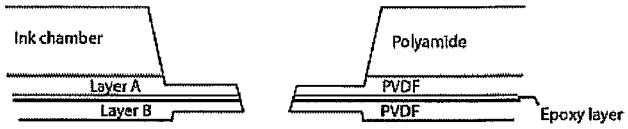
Figure 2D:
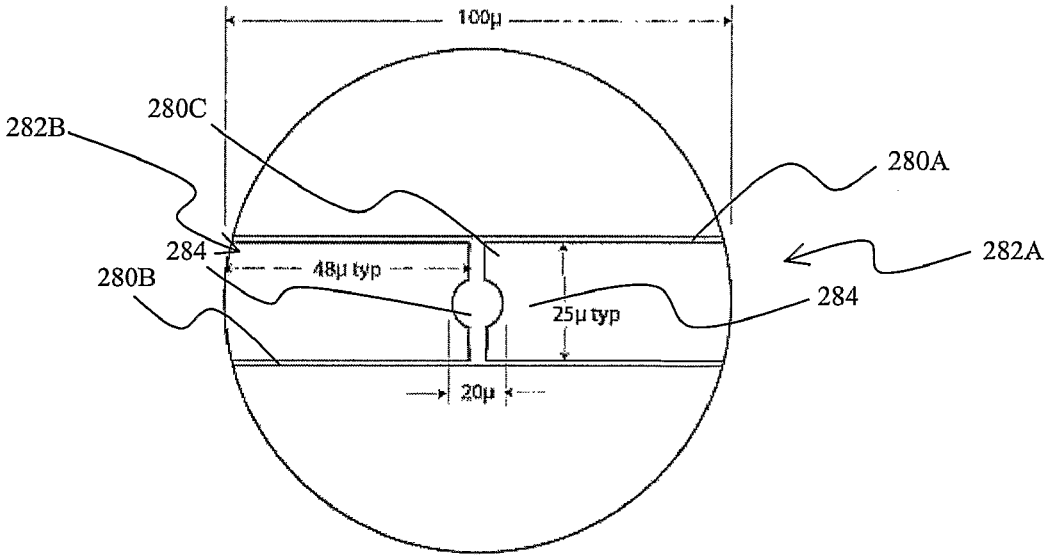
FIG. 2D is a more detailed schematic representation of yet another exemplary printhead configuration.

FIGS. 2A-2C depict a bimorph piezoelectric construction in more detail. Here, the piezoelectric layers 160A and 160B are fabricated from a PVDF composite material that also includes lead zirconium titanate. An opening 164 is formed within and across the layers to form the nozzle. Each of the layers is electrically coupled to corresponding conductive layers (not shown), and the first and second piezoelectric layers are separated by an epoxy layer 162. The nozzle in such configurations is thus formed from two piezoelectric layers having a common opening. A porous layer 166 may be provided as ink chamber or conduit, while a polyamide layer 168 may be provided as structural support and base with driver electronics. Depending on the manner of manufacture, the piezoelectric layers approaching opening 164 may have the same thickness as originally applied, or may be partially ablated on one (FIG. 2B) or both sides (FIG. 2C) of the opening 164. Alternatively, the bimorph may also provide linear motion in a configuration as depicted in FIG. 2D. Here, the bimorph has cutouts 280A, 280B, and 280C to form tabs 282A and 282B, which include half-circular openings 284 to thus form the nozzle. Regardless of the particular shape of the bimorph, the PVDF is preferably less than 10 microns, and more preferably less than 5 microns to achieve appropriate deflection of the annular ring. It should be appreciated that when the bimorph nozzle has an electric field applied in one direction, the annular ring of PVDF will flex upward, suspending an amorphous glob of ink in mid-air. When the bimorph is excited with the opposite polarity field, the PVDF annular ring will flex downward accelerating the drop away from the printhead and ink manifold (in the FIGS. 2A-2C, the ink manifold is situated above the nozzle). This approach requires no pressurization of the ink manifold chamber (ink cartridge). In order to achieve drop ejection the PVDF annular ring may be run at its mechanical resonant frequency for some number of cycles of flexure. It should be noted that operating at resonance increases the deflection effect by a factor of the Q of the structure. In this case that multiplying effect is approximately 10. However, if sufficient deflection is achieved any optimum operational frequency may be used.

With respect to appropriate piezoelectric materials, it is generally contemplated that all piezoelectric materials are suitable as long as such materials can be deposited and/or formed into a sufficiently thin film or layer, most preferably from a liquid or vapor phase. Moreover, it is also preferred that the piezoelectric material can be processed after deposition in a spatially controlled manner. Consequently, especially preferred piezoelectric materials include synthetic polymers that are treated to impart piezoelectric character. For example, PVDF can be stretched along one dimension to impart such characteristic. Alternatively, and even more preferably, a synthetic organic polymer or mixture thereof may also be compounded with an inorganic piezoelectric materials (e.g., PZT) at a desired concentration to achieve piezoelectric character. In still further contemplated examples, piezoelectric materials may also be deposited from vapor phase.

Conductive layers are preferably formed from an organic polymer that is either rendered electrically conductive, or treated to at least partially improve adhesion to a metal. There are numerous conductive organic polymers known in the art, and all of those are considered suitable for use herein. Once more, particularly preferred polymers (conductive, metallized, and/or hydrophilized) include those that can be deposited from a liquid onto a surface to form a film.

Therefore, it is particularly preferred that the piezoelectric material, and even more preferably the conductive layers and other layers of the device are deposited from a liquid phase that is then processed to form the final functional layers. For example, suitable processing may include evaporation of solvent, irradiation of the deposited film to start radical polymerization, crosslinking with added chemical, etc. Deposition of the material will typically depend to at least some degree on the particular material used, and all known deposition, laminate, and film-forming techniques are deemed suitable for use herein. Thus, contemplated depositions include spray-coating, blade coating, wire-coating, dipping, etc. Consequently, it should be appreciated that suitable geometrical arrangements of the functional materials can be achieved by numerous methods well known in the art. Most preferably, patterning is achieved using photolithographic processes using positive and/or negative photoresist, etching, and masking. Similarly, holes, channels, and chambers are preferably drilled using excimer laser techniques. Of course, it should be recognized that multiple layers can be applied to form more complex structures, again using compositions and methods well known in the art. Further preferred manipulations also include deposited structures (e.g., piezoelectric cylindrical nozzle) using a diamond saw. Where appropriate, the layers can be formed on a disposable surface (i.e., carrier not integrated into the final printhead), or on a functional material (e.g., porous silicon or porous ceramic).

It should thus especially recognized that by using compositions and methods according to the inventive subject matter a unitary printhead can be manufactured that comprises one or more ink channels, ink manifolds, ink chambers, and a piezoelectric actuator, wherein preferably all of the components are formed from layer formation, comprise PVDF or other polymer having a high affinity to bind metal, and wherein the piezoelectric material forms the nozzle through which the ink exits the printhead.

Especially preferred monomorph nozzle configurations will use a relatively thick PVDF composite film (preferably comprising PVDF and PZT), typically between 10-1000 microns, and more typically between 100-600 microns. Depending on the particular need, the horizontal cross section of a nozzle opening may be round, square, or otherwise shaped. However, it is generally preferred that the horizontal cross section of the nozzle is round and has a diameter of between 10-100 microns, and has a wall thickness of between 10 and 100 microns. Thus, a typical monomorph nozzle will have tubular/cylindrical shape.

To fabricate contemplated bimorph nozzle configurations, two PVDF composite films are laminated together, which ensures a high degree of accuracy with a patterned metal layer on the inside. The outer metal layers can be made of any suitable material, including for example a solid copper ground plane. Epoxy is preferably applied to one film using known techniques to achieve a 1-2 micron thick layer. The patterned metallization and the dipole polarization of the PVDF are aligned in the same direction, while the patterned metallization is applied to the bottom of one layer and the mirror image of it is applied to the top of the other layer. Alternatively, the dipole polarization of the PVDF composite sheets may also be aligned in opposing directions maintaining the metallization on the bottom of one layer and the top of the other layer. Finally, the patterned metallization may also be applied to the top of one layer and the bottom of the other layer. of course, it should be noted that opposite sides of the PVDF films may be patterned for metallization or may be solid metal planes with openings for the nozzle orifices.

To fabricate a bimorph nozzle with single layer encroachment (see FIG. 2B), two PVDF composite films are laminated together as described above. The desired encroachment is ablated using an excimer laser. Then the encroachment is metallized using sputtering technique or other methods as discussed in U.S. Pat. No. 5,783,641. An ink chamber polyamide is then laminated to or formed on the bimorph assembly. The so formed layered film is then turned over and the nozzle orifices are ablated (e.g., via laser) through the entire structure. The film is turned over again and the ink chambers are ablated down to the metal of inner layer. Alternatively, the two layers may be aligned independently of the nozzle orifices using reference indices on the material. In this instance the structure could be ablated from a single direction. Either the ink chamber and then the nozzle orifice could be ablated or first the nozzle orifice and then the ink chamber could be ablated.

To fabricate the bimorph with encroachment into both layers (see FIG. 2C), the two PVDF composite films are laminated as described above. The encroachment into one layer is ablated and the exposed material is metallized. The ink chamber polyamide is then laminated to the bimorph. The laminated film is turned over and the nozzle orifices are ablated through the entire assembly. The encroachment in the other layer is then ablated and metallized. The film is turned over again and the ink chamber is ablated down to the metal of Layer A. Of course, it should be recognized that various alternate ablative sequences may be used to achieve the desired structure.

With respect to an ink chamber (and/or channel) layer, it is contemplated that the layer can be laminated to the nozzle assembly and then ablated into appropriate shape (or formed on the nozzle assembly using photolithographic processes). Typically, the ink chamber or channel can be derived from standard polyamide material (e.g., between about 20-500 microns thick). The laminated film is then turned over, and the nozzle orifices ablated using a masked excimer laser system. The film is then turned over again so that the ink chamber can be ablated (again with an excimer laser) down to the copper metal of the piezoelectric layer. Alternatively, the two layers may be aligned independently of the nozzle orifices using reference indices on the material. In this instance the structure could be ablated from a single direction. Either the ink chamber and then the nozzle orifice could be ablated or first the nozzle orifice and then the ink chamber could be ablated. At this point the nozzle array is complete.

Once complete, the printhead is attached to a polyamide connector film or other structure that provides printhead circuit connections, the converter IC attachment, connections circuit, and/or the printer pin access pads. The connector film or other structure can be a separate polyamide film to which the printhead is tab bonded or bonded in some other way, or it can be a metallized extension of the ink chamber polyamide layer described above, in which case the printhead will be an integral part of the connector film.

At this point the printhead can be probed and exercised on a sampling basis or on a 100% inspection basis. Once complete, the converter IC is attached to the flex circuit using standard IC attachment methods, which may include epoxy die attach and wire bonding, flip chip, solder ball assembly, any other assembly process, etc. The complete connector film, converter IC, printhead assembly is preferably tested for end-to-end functionality. Once complete, the flex assembly is attached to the print cartridge plastic shell. The cartridge is filled with ink, tested, sealed, and packaged for shipment.

Figure 3A:
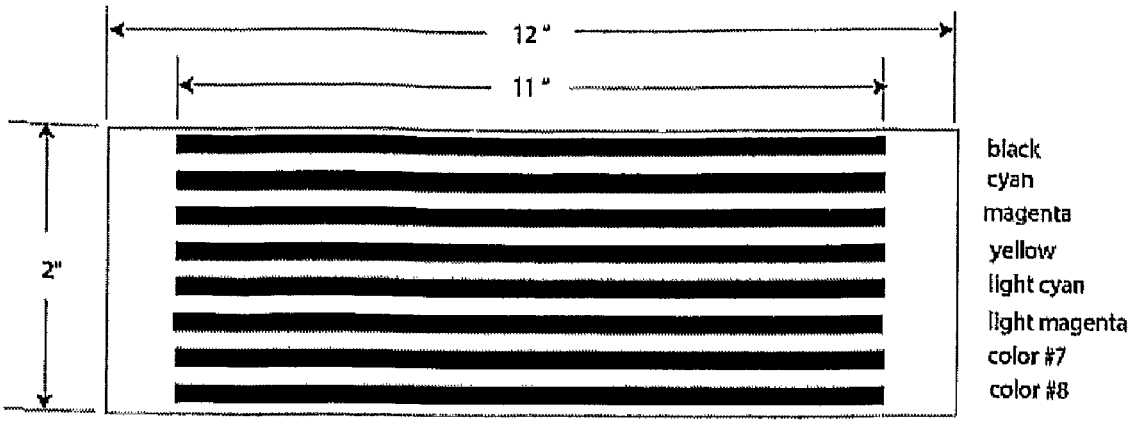
FIG. 3A is a schematic representation of an ink layout in a page-wide printhead according to the inventive subject matter.
Figure 3B:
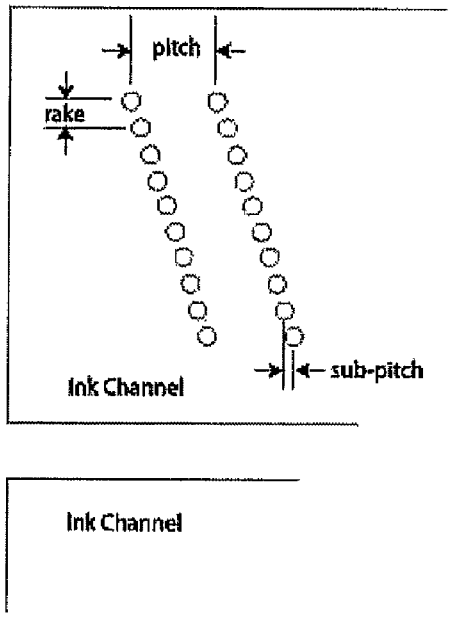
FIG. 3B is a is a schematic representation of a nozzle layout in a printhead according to the inventive subject matter.

It should be especially appreciated that contemplated printhead devices and methods allow for manufacture using relatively large sheets of film. Consequently, strip-type printheads can be constructed having a printing element that could, for example, be 11.5 inches long and include several rows of nozzles that each eject a different color of ink. By providing 4, 6, 8 or more rows, 4-, 6-, 8- or more colors can be concurrently printed as exemplarily depicted in FIG. 3A. Notably, the configuration of contemplated printheads is therefore mostly dictated by the desired use rather than manufacture considerations. Furthermore, it is contemplated that within an ink channel, the ink nozzles can be arrayed to achieve any number of desired printing resolutions as shown in FIG. 3B. The horizontal resolution would be dependent on the pitch and the sub-pitch of the nozzles. Vertical resolution is dependent on the pulse repetition rate of the nozzles. The rake of the nozzles will determine the density of nozzles in the array, which affects horizontal resolution.

Therefore, it should be appreciated that contemplated printheads can be fabricated in various lengths and widths for specific printer applications. In particularly preferred instances, utilizing such a printhead removes the requirement for a scanning carriage assembly in the printer. Since the only moving parts in the printer would then be the paper feed mechanism, an entire line can be printed simultaneously, thus dramatically increasing the speed of any full color process printer. With contemplated devices, the limiting factor on speed is the dry time of the ink (speeds of 50 ppm should be easily achievable). Printheads according to the inventive subject matter will have application in photo, desktop, wide format, and very wide format printing. Other applications, besides paper printing, include outdoor signage, textile printing, carton and packaging printing, etc. Non-traditional printing applications may include artificial skin fabrication, printed circuit board fabrication, RFID antennae fabrication, plastic electronics fabrication, flat panel display systems flexible display systems, etc.

Thus, specific embodiments and applications of piezoelectric printheads have been disclosed. It should be apparent, however, to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Furthermore, where a definition or use of a term in a reference, which is incorporated by reference herein is inconsistent or contrary to the definition of that term provided herein, the definition of that term provided herein applies and the definition of that term in the reference does not apply.

What is claimed is:

1. A printhead comprising:

a piezoelectric layer electrically coupled to a first and a second conductive layer such that the piezoelectric layer deforms in response to a voltage applied to the first and second conductive layers, and wherein the piezoelectric layer has a first surface and a second surface;

wherein the first conductive layer is conductively coupled to the first surface and wherein the second conductive layer is conductively coupled to the second surface;

wherein the piezoelectric and the first and the second conductive layers have a composition that allows deposition of the layers from a liquid phase; and wherein the piezoelectric layer has a pore extending from the first surface to the second surface and to thereby form a nozzle through which ink is expellable from a volume inside the printhead onto a surface outside of the printhead in response to the applied voltage.

2. The printhead of claim 1 wherein the piezoelectric layer comprises a piezoelectric polymer.

3. The printhead of claim 2 wherein the piezoelectric polymer comprises polyvinylidene-difluoride, and optionally lead zirconium titanate.

4. The printhead of claim 1 wherein at least one of the first and second conductive layers comprises a metallized polymer.

5. The printhead of claim 1 wherein the piezoelectric layer has a monomorph piezoelectric structure and has a tubular configuration.

6. The printhead of claim 5 wherein the piezoelectric layer is configured such that an inner diameter of the pore is constricted upon application of the voltage.

7. The printhead of claim 1 wherein the piezoelectric layer has a bimorph piezoelectric structure and has a ring-shaped configuration.

8. The printhead of claim 7 wherein the piezoelectric layer is configured such that an outer surface of the pore is propelled in direction of the surface upon application of the voltage.

9. The printhead of claim 1 further comprising an optionally porous polymeric or inorganic layer coupled to at least one of the first and second conductive layers and configured to provide at least one of ink channel, an ink filter, an ink reservoir, a fluidic resistor, and an electrical connector to a control circuit.

10. A method of forming a printhead nozzle, comprising:

forming on a substrate a piezoelectric layer from a flowable composite material;

forming a first conductive layer on the piezoelectric layer to thereby electrically connect the piezoelectric layer with the first conductive layer;

forming a pore through the piezoelectric layer, wherein the pore has a size sufficient to allow the pore to deform in an amount effective to expel ink from one side of the piezoelectric layer to the other when a voltage is applied to the first conductive layer; and wherein the ink is formulated to provide sufficient conductivity to thereby allow the ink to function as a second conductive layer for the application of the voltage.

11. The method of claim 10 further comprising a step of forming an addition conductive layer on the piezoelectric layer to thereby electrically connect the piezoelectric layer with the additional conductive layer.

12. The method of claim 10 wherein the piezoelectric layer is configured as a monomorph piezoelectric structure.

13. The method of claim 12 wherein the monomorph piezoelectric structure has a cylindrical shape.

14. The method of claim 10 further comprising a step of forming a second piezoelectric layer to thereby form a bimorph piezoelectric structure together with the first piezoelectric layer.

15. The method of claim 14 wherein the bimorph piezoelectric structure has a ring shape.

16. The method of claim 10 further comprising a step of depositing a photoresist layer and patterning the photoresist layer prior to at least one of the steps of forming the piezoelectric layer and forming the conductive layer.

17. The method of claim 10 further comprising a step of forming an optionally porous polymeric or inorganic layer coupled to at least one of the first and second conductive layers and configured to provide at least one of ink channel, an ink filter, an ink reservoir, a fluidic resistor, and an electrical connector to a control circuit.

18. The method of claim 10 wherein the composite material comprises an organic polymer and an inorganic piezoelectric ceramic.

19. A method of forming a printhead nozzle, comprising:

forming on a substrate a piezoelectric layer from a liquid composite material;

forming a pore through the piezoelectric layer, wherein the pore has a size sufficient to allow the pore to deform in an amount effective to expel ink from one side of the piezoelectric layer to the other when a voltage is applied to a first conductive layer;

wherein the pore has a tubular structure with an inner diameter surface and an outer diameter surface; and forming the first conductive layer on the outer diameter surface of the tubular structure.

20. The method of claim 19 wherein the ink is formulated to provide sufficient conductivity to thereby allow the ink to function as a second conductive layer for the application of the voltage.

21. The method of claim 19 further comprising a step of forming a second conductive layer on the piezoelectric layer to thereby electrically connect the piezoelectric layer with the second conductive layer.

22. The method of claim 19 wherein the piezoelectric layer is configured as a monomorph piezoelectric structure.

23. The method of claim 19 further comprising a step of forming an optionally porous polymeric or inorganic layer that is coupled to at least one of the first conductive layer and the piezoelectric layer, and that is configured to provide at least one of ink channel, an ink filter, an ink reservoir, a fluidic resistor, and an electrical connector to a control circuit.

24. The method of claim 19 wherein the composite material comprises an organic polymer and an inorganic piezoelectric ceramic.

* * * * *